US011781429B1

(12) United States Patent
Zeng et al.

(10) Patent No.: US 11,781,429 B1
(45) Date of Patent: Oct. 10, 2023

(54) METHOD FOR BLOCKING MINE WATER INRUSH

(71) Applicants: CHINA UNIVERSITY OF MINING AND TECHNOLOGY, BEIJING, Beijing (CN); University of Mining and Technology-Beijing Inner Mongolia Research Institute, Ordos (CN)

(72) Inventors: Yifan Zeng, Beijing (CN); Qiang Wu, Beijing (CN); Weihong Yang, Beijing (CN); Zhaolai Hua, Yulin (CN); Yanping Miao, Yulin (CN); Lu Wang, Yulin (CN); Kai Pang, Beijing (CN); Lei Yang, Yulin (CN); Aoshuang Mei, Ordos (CN); Shihao Meng, Beijing (CN); Han Bao, Beijing (CN); Xue Liu, Beijing (CN); Xuan Xiao, Beijing (CN)

(73) Assignees: CHINA UNIVERSITY OF MINING AND TECHNOLOGY, BEIJING, Beijing (CN); University of Mining and Technology—Beijing Inner Mongolia Research Institute, Ordos (CN)

( * ) Notice: Subject to any disclaimer, the term of this patent is extended or adjusted under 35 U.S.C. 154(b) by 0 days.

(21) Appl. No.: 18/332,606

(22) Filed: Jun. 9, 2023

(30) Foreign Application Priority Data

Jul. 4, 2022 (CN) ..... 202210791281.1

(51) Int. Cl.

| | |
|---|---|
| ***E21D 11/10*** | (2006.01) |
| ***E21D 11/38*** | (2006.01) |
| ***E21B 33/13*** | (2006.01) |

(52) U.S. Cl.
CPC ..... *E21D 11/38* (2013.01); *E21B 33/13* (2013.01); *E21D 11/10* (2013.01)

(58) Field of Classification Search
CPC ..... E21D 11/38; E21D 11/10; E21B 33/13
See application file for complete search history.

(56) References Cited

U.S. PATENT DOCUMENTS

| | | | | |
|---|---|---|---|---|
| 4,437,520 | A | 3/1984 | Stoddard et al. | |
| 7,334,644 | B1 * | 2/2008 | Ozment | E21F 17/103 239/311 |

(Continued)

FOREIGN PATENT DOCUMENTS

| | | | |
|---|---|---|---|
| CN | 106050234 | A | 10/2016 |
| CN | 108999634 | A | 12/2018 |

(Continued)

OTHER PUBLICATIONS

First Office Action issued in counterpart Chinese Patent Application No. 202210791281.1, dated Mar. 7, 2023.

*Primary Examiner* — Carib A Oquendo
(74) *Attorney, Agent, or Firm* — Westbridge IP LLC

(57) ABSTRACT

A method for blocking mine water inrush includes: grouting first slurry into an interface between the quaternary aquifer and the weathered bedrock aquifer in a fracture grouting manner until a first preset condition is met; forming a first water-resisting cushion after the first slurry is solidified; drilling a curve branch drill hole in the surface horizon downward; grouting second slurry into the curve branch drill hole in a downward grouting manner until a second preset condition is met; forming a second water-resisting cushion after the second slurry is solidified; grouting third slurry onto a top of the first water-resisting cushion in an upward grouting manner until a third preset condition is met; forming a third water-resisting cushion after the third slurry is (Continued)

solidified; wherein the third water-resisting cushion is located on the top of the first water-resisting cushion.

10 Claims, 3 Drawing Sheets

(56) References Cited

U.S. PATENT DOCUMENTS

| | | | | |
|---|---|---|---|---|
| 11,459,849 | B1 * | 10/2022 | Zeng | E21B 27/00 |
| 2016/0356138 | A1 * | 12/2016 | Hughes | E21B 43/281 |

FOREIGN PATENT DOCUMENTS

| | | | |
|---|---|---|---|
| CN | 110043312 | A | 7/2019 |
| CN | 110761814 | A | 2/2020 |
| CN | 112392431 | A | 2/2021 |
| CN | 112879011 | A | 6/2021 |

* cited by examiner

METHOD FOR BLOCKING MINE WATER INRUSH

CROSS-REFERENCE TO RELATED APPLICATIONS

This application claims priority to Chinese Patent Application No. 202210791281.1, filed on Jul. 4, 2022, the content of which is incorporated herein by reference in its entirety.

TECHNICAL FIELD

The present application relates to a technical field of mine flooding preventions and surface deformation controls, and in particular to a method for blocking mine water inrush.

BACKGROUND

Water flowing fractured zones would be developing rapidly due to high-intensity mining of coal seams. In some mine regions, the water flowing fractured zones have already been developed into bedrock aquifers. Due to a lack of red clay water-resisting cushions in a part of mine regions, there is a large hydraulic recharge relationship between Salawusu Formation aquifers (i.e., the quaternary aquifers) and the bedrock aquifers. Moreover, groundwater may flow into the mines through the bedrock aquifers and the water flowing fractured zones. In these situations, the quaternary aquifers may become a stable mine water inflow source and a large amount of water would flow into mine goafs.

Moreover, with effects of periodic weighting of coal seam roofs, mine water inrush accidents are prone to occurring in the mine goafs. These accidents endanger underground safety. Also, high-intensity mining of the coal resources is prone to causing surface deformation. As a result, irreversible environmental damages such as land destruction and soil erosion may occur.

At present, preventions of roof floodings can be mainly classified into two categories: one is to use specific mining technologies, such as filling mining, height-limited mining, change on a mining method, setting of waterproof coal pillars and etc., to inhibit a development height of the water flowing fractured zone. The other method is to transform a roof aquifer, such as pre-drainage of the aquifer and grouting for channel blocking. The above methods have respective characteristics and have certain effects, but they also have certain limitations. For example, the first kind of methods may cause huge waste of coal resources in a case of mining a thick coal seam and the like. In the second kind of methods, if there are many sources of aquifer recharge, water drainage solutions cannot be performed. In addition, there are no suitable methods to control surface deformations caused by high-intensity mining.

Therefore, how to prevent a mine roof flooding and control surface deformations to protect groundwater resources and solve the problems such as mine water inrush becomes a problem to be solved.

SUMMARY

Examples of the present disclosure provide a method for blocking mine water inrush.

The method may include the following steps: conducting a geological prospecting in a mining region; wherein the geological prospecting comprises: prospecting positions, thickness and water distribution of a quaternary aquifer, a weathered bedrock aquifer and a water flowing fractured zone under a surface horizon; determining that the water flowing fractured zone has developed into the weathered bedrock aquifer and there is a leakage recharge from the quaternary aquifer to the weathered bedrock aquifer; wherein, the weathered bedrock aquifer is located under the quaternary aquifer; grouting first slurry into an interface between the quaternary aquifer and the weathered bedrock aquifer in a fracture grouting manner until a first preset condition is met; stopping grouting the first slurry; forming a first water-resisting cushion after the first slurry is solidified; drilling a curve branch drill hole in the surface horizon downward; wherein a top of the curve branch drill hole is located in the weathered bedrock aquifer and a bottom of the curve branch drill hole is located on or under a top of the water flowing fractured zone; grouting second slurry into the curve branch drill hole in a downward grouting manner until a second preset condition is met; stopping grouting the second slurry; forming a second water-resisting cushion after the second slurry is solidified; grouting third slurry onto a top of the first water-resisting cushion in an upward grouting manner until a third preset condition is met; stopping grouting the third slurry; and forming a third water-resisting cushion after the third slurry is solidified; wherein the third water-resisting cushion is located on the top of the first water-resisting cushion.

It can be seen from the above, in the method disclosed, water-resisting cushions may be reconstructed at the interface between rock stratus. Specifically, vertical leakage recharge from the quaternary aquifer to the weathered bedrock aquifer may be blocked a first water-resisting cushion formed by grouting first slurry into the interface between the quaternary aquifer and the weathered bedrock aquifer. Then, water flowing channels in the water flowing fractured zone of a mined roof may be cut by a second water-resisting cushion formed by grouting second slurry into curve branch drill holes. Finally, a total cushion height may be increased by a third water-resisting cushion formed by grouting third slurry on the top of the first water-resisting cushion. In this way, the height of the surface horizon can be increased accordingly. Therefore, surface deformations caused by mining a coal seam can be effectively controlled.

By integrating these three grouting processes with different slurry at different positions, in one aspect, a mine roof flooding can be prevented and a mine water inrush can be blocked. In another aspect, surface deformations caused by mining can also be comprehensively and effectively controlled. In still another aspect, groundwater resources can also be protected.

BRIEF DESCRIPTION OF THE DRAWINGS

In order to describe the technical solutions in one or more examples of the present disclosure or the prior art more clearly, the following briefly introduces accompanying drawings for describing the examples or the prior art. Apparently, the accompanying drawings in the following description show only the examples of the present disclosure, and those of ordinary skill in the art may still derive other drawings from these drawings without any creative efforts.

DETAILED DESCRIPTION OF THE EMBODIMENTS

Figure 1:
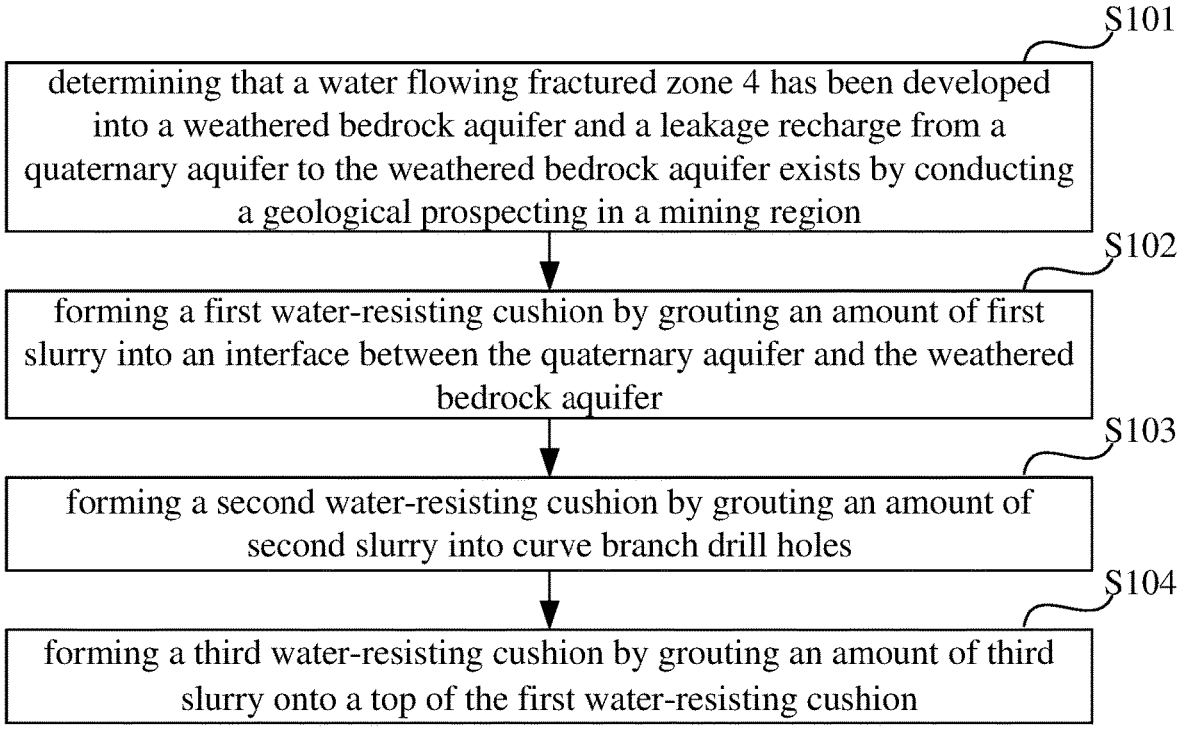
FIG. 1 is a flow chart illustrating a method for blocking mine water inrush according to some examples of the present disclosure.

To make the objectives, technical solutions and advantages of the present disclosure clearer, the present disclosure will be further described in detail below in conjunction with specific examples and with reference to the accompanying drawings.

It should be noted that, unless otherwise defined, technical terms or scientific terms used in one or more examples of the specification should have the ordinary meanings as understood by those of ordinary skill in the art to which the present disclosure belongs. The terms "first", "second" and similar words used in one or more examples of the specification do not denote any order, quantity, or importance, but are merely used to distinguish different components. The terms "including" or "comprising" and the like are intended to indicate that elements or objects in front of the word encompass elements or objects listed after the word and their equivalents, but do not exclude another element or object. Similar terms such as "connected" or "linked" are not limited to physical or mechanical connections, but may include electrical connections, whether direct or indirect. The terms "upper", "lower", "left", "right" and the like are only used to represent a relative positional relationship, and when an absolute position of a described object changes, the relative positional relationship may also change accordingly.

Before describing specific examples of the present disclosure, reference numerals in the drawings are introduced at first.

In the drawings, reference number 1 refers to a grouting station; reference number 2 refers to an original surface horizon; reference number 3 refers to a first water-resisting cushion; reference number 4 refers to a water flowing fractured zone; reference number 5 refers to a goaf; reference number 6 refers to a coal seam; reference number 7 refers to an interface between a quaternary aquifer and a weathered bedrock aquifer; reference number 8 refers to a bottom of the weathered bedrock aquifer; reference number 9 refers to a top of the water flowing fractured zone; reference number 10 refers to a deformed surface horizon; reference number 11 refers to a curve branch drill hole; reference number 12 refers to a second water-resisting cushion; reference number 13 refers to a controlled surface horizon; reference number 14 refers to a third water-resisting cushion; reference number 15 refers to a vertical drill hole; reference number 16 refers to a grouting volume monitoring module; reference number 17 refers to a slurry property monitoring module; reference number 18 refers to a grouting pressure monitoring module; and reference number 19 refers to a comprehensive data processing module.

Referring to FIG. 1, the present disclosure provides a method for blocking mine inrush. Specifically, the method may include the following steps.

In step S101, a geological prospecting in a mining region is conducted.

During the geological prospecting, positions, thickness and water distribution of a quaternary aquifer, a weathered bedrock aquifer and a water flowing fractured zone 4 under a surface horizon are prospected to determine whether the water flowing fractured zone 4 has been developed into the weathered bedrock aquifer and whether there is a leakage recharge from the quaternary aquifer to the weathered bedrock aquifer.

In examples of the present disclosure, the weathered bedrock aquifer is located under the quaternary aquifer.

Specifically, in general, a mining region may include a surface horizon, the quaternary aquifer and the weathered bedrock aquifer in an order from top to bottom. A coal seam 6 and a goaf 5 may be located under the weathered bedrock aquifer. Due to a high-intensity coal mining in the mining region, a height of the water flowing fractured zone 4 may be increased, so that the water flowing fractured zone 4 may develop into the weathered bedrock aquifer. As a result, the quaternary aquifer may connect the weathered bedrock aquifer and the water flowing fractured zone 4. Groundwater may flow into the goaf 5 which may cause a sharp increase in mine water inflow. Meanwhile, in an ecologically fragile area, environmental problems such as groundwater loss and land desertification are prone to occurring. Further, the surface horizon may subside to deform. Examples of the present disclosure are proposed to solve the above problems.

Specifically, through an indoor mechanical test with relevant drilling data and other means, a depth of the quaternary aquifer, a depth of the weathered bedrock aquifer, physical and mechanical parameters of various rock stratus of the roof, and a depth of an interface between the quaternary aquifer and the weathered bedrock aquifer can be obtained.

According to methods and devices of geophysical prospecting, drilling, a transient electromagnetic measurement, a flow velocity detection on groundwater and a flow direction detection on groundwater, whether there is a leakage recharge from the quaternary aquifer to the weathered bedrock aquifer can be determined. Meanwhile, whether the water flowing fractured zone 4 has been developed into the weathered bedrock aquifer can also be determined. In this case, the water flowing fractured zone 4 may become a water flowing channel connecting the weathered bedrock aquifer and the quaternary aquifer. As a result, groundwater may flow into the goaf 5 along the water flowing fractured zone 4, and the amount of groundwater flowing into the goaf 5 may be very large.

In response to determining that the water flowing fractured zone 4 has been developed into the weathered bedrock aquifer and a leakage recharge from the quaternary aquifer to the weathered bedrock aquifer exists, proceed to Step S102.

In Step S102, an amount of first slurry is grouted into an interface between the quaternary aquifer and the weathered bedrock aquifer in a fracture grouting manner until a first preset condition is met. In this way, a first water-resisting cushion 3 may be formed after the first slurry grouted is solidified.

According to examples of the present disclosure, this grouting process can be called as a first grouting process or a fractured grouting process, and the first grouting process would not be stopped until the first preset condition is met.

Figure 2:
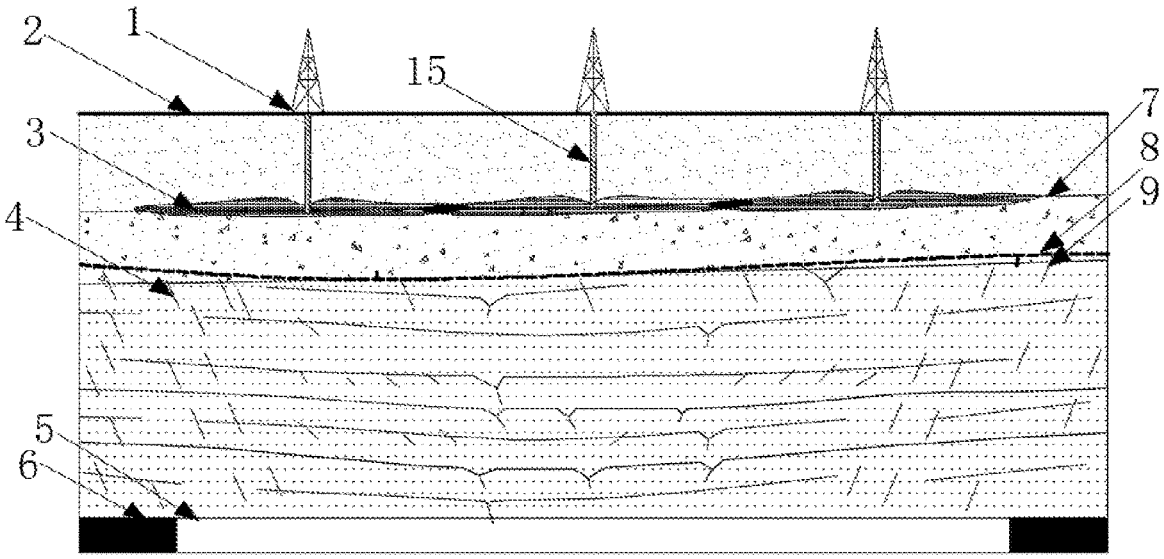
FIG. 2 is a schematic diagram illustrating a first water-resisting cushion formed according to an example of the present disclosure.

Specifically, referring to FIG. 2, before mining, one or more vertical drill holes 15 may be drilled from the surface horizon downward. A bottom of a vertical drill hole 15 may be located at the interface 7 between the quaternary aquifer and the weathered bedrock aquifer. In the method disclosed, an amount of the first slurry may be grouted into the vertical drill holes 15 at first. Further, by increasing a grouting pressure extruding the interface 7 caused by the first slurry grouted into the vertical drill holes 15, fracturing may occur along the interface 7. This process may also be called as a fractured grouting. To be noted, once the grouting pressure caused by the first slurry exceeds a tensile strength, a minor principal stress surface with a minimum resistance of the rock mass may produce a hydraulic fracture, which may form a fracture surface in the rock mass and the amount of the first slurry needs to be grouted into the vertical drill holes 15 would be increased.

To be noted, in examples of the present disclosure, the grouting pressure caused by the first slurry may be larger than or equal to a vertical stress of the interface 7 between the quaternary aquifer and the weathered bedrock aquifer.

Moreover, the vertical stress of the interface 7 between the quaternary aquifer and the weathered bedrock aquifer may be determined by a formula (1) as follows.

$$\sigma_v=\gamma h \tag{1}$$

Where, $\gamma$ represents a volume weight ($N/m^3$) of a quaternary rock stratum; and h represent an average vertical distance (m) from the interface 7 between the quaternary aquifer and the weathered bedrock aquifer to the surface horizon.

As the grouting pressure is acting on the interface 7 between the rock stratus, a lateral stress of the interface 7 is mainly a relatively small friction force. That is, the lateral stress of the interface 7 is far smaller than the vertical stress of the interface 7. In this case, when the grouting pressure caused by the first slurry is larger than or equal to the vertical stress of the interface 7 between the quaternary aquifer and the weathered bedrock aquifer, due to the lateral stress of the interface 7 is much smaller, the first slurry may mainly perform a horizontal fracture extension along the interface 7 between the quaternary aquifer and the weathered bedrock aquifer, thereby a horizontal grouting layer which is called a first water-resisting cushion 3 can be formed. That is, the first water-resisting cushion 3 finally formed is a horizontally distributed water-resisting cushion at the interface 7 between the quaternary aquifer and the weathered bedrock aquifer.

During the process of the above fractured grouting, a slurry diffusion range of the fractured surface, i.e. a range of the first water-resisting cushion 3 of a single vertical drill hole 15 may be represent as the following formula (2).

$$R = 2.21\sqrt{\frac{0.093\gamma_g Hb^2 r^{0.21} t}{\mu_g}} + r \tag{2}$$

Where, $\gamma_g$ represents a gravity density ($kN/m^3$) of the first slurry; H represents a difference between a grouting pressure head of the grouting pressure and a groundwater pressure head; b represents a fracture aperture; r represents a radius of the vertical drill hole 15 for grouting; t represents a grouting time; and $\mu_g$ represents a kinematic viscosity (MPa·s) of the first slurry.

According to some examples of the present disclosure, a plurality of vertical drill holes 15 may be set, and the plurality of vertical drill holes 15 may be uniformly distributed in a to-be-grouted region. In this example, an interval between two adjacent vertical drill holes 15 may be set as smaller than or equal to 30 m. Moreover, a diffusion radius of the slurry diffusion range of a single vertical drill hole 15 may be larger than or equal to 20 m. In this way, the slurry diffusion ranges of two adjacent vertical drill holes 15 would be intersected with each other. Therefore, an integrity and an impermeability of the first water-resisting cushion 3 would be ensured.

According to some examples of the present disclosure, the first preset condition may be set according to general standards in the technical field of water-controlled coal mining and grouting transformation of aquifers, in combination with actual situations of mining areas. For example, in a specific example, the first preset condition may be set as the grouting pressure caused by the first slurry is stabilized at about 2.5 MPa for more than 20 minutes. On condition that the first grouting process is performed until the first preset condition is met, it means that the first grouting process is completed.

Once the first preset condition is met, the first grouting process of the first slurry can be stopped. Moreover, after the first slurry is solidified, the first water-resisting cushion 3 can be formed at the interface 7 between the quaternary aquifer and the weathered bedrock aquifer. The first water-resisting cushion 3 may block water flowing from the quaternary aquifer to the weathered bedrock aquifer. Therefore, the leakage recharge from the quaternary aquifer may be cut from the source, and a transformation on foundations of the weathered bedrock aquifer may be achieved.

To be noted, step S102 may be performed before or after mining. The specific time for performing step S102 is not specifically limited herein and can be determined according to actual engineering situations. However, the following step S103 and step S104 both need to be performed after mining.

In Step S103, a plurality of curve branch drill holes 11 are drilled. A top of a curve branch drill hole 11 may be located in the weathered bedrock aquifer and a bottom of the curve branch drill hole 11 may be located on or under a top of the water flowing fractured zone 4. Further, an amount of second slurry may be grouted into the curve branch drill holes 11 in a downward grouting manner until a second preset condition is met. This grouting process can be called as a second grouting process. Once the second preset condition is met, the second grouting process may be stopped. As a result, a second water-resisting cushion 12 may be formed after the second slurry is solidified.

Figure 3:
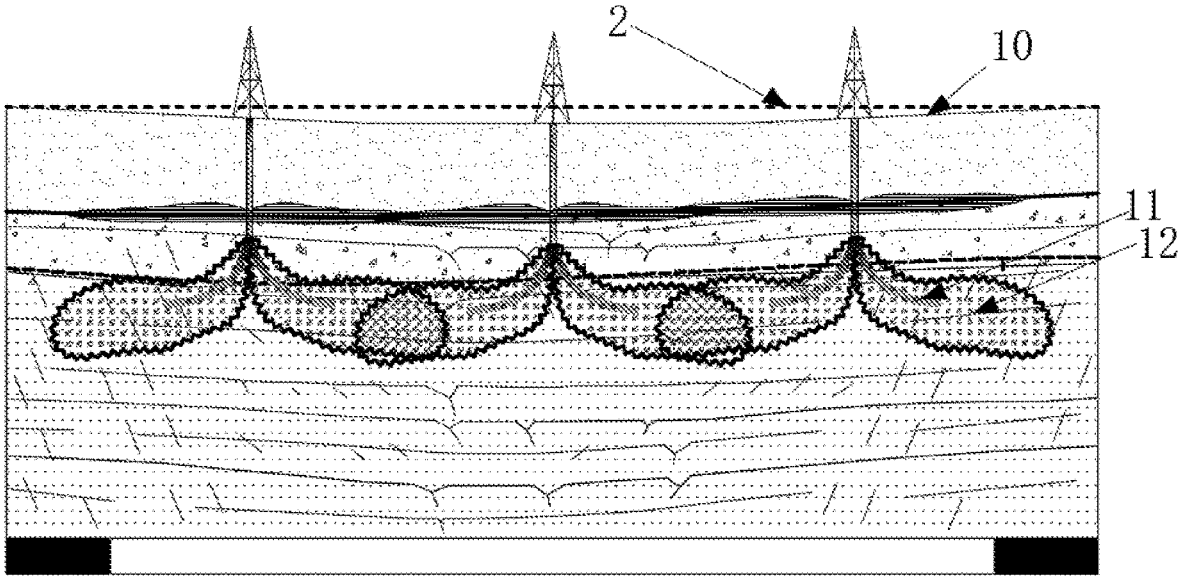
FIG. 3 is a schematic diagram illustrating a water flowing fractured zone blocked with grouting according to example of the present disclosure.

Specifically, referring to FIG. 3, the bottoms of the vertical drill holes 15 may be connected to the top of the curve branch drill hole 11. A plurality of vertical drill holes 15 and a plurality of curve branch drill holes 11 are provided. Moreover, each vertical drill hole 15 may be connected to at least two curve branch drill holes 11. The two curve branch drill holes 11 may be symmetrically distributed taking a central axis of their corresponding vertical drill hole 15 as an axis.

In a specific example, a plurality of vertical drill holes 15 are provided. Each vertical drill hole 15 is connected to four curve branch drill holes 11. The four curve branch drill holes 11 are uniformly symmetrically distributed taking the central axis of the corresponding vertical drill hole 15 as an axis. An interval between two adjacent vertical drill holes 15 is smaller than or equal to 30 m and a diffusion radius of the slurry diffusion range of a single curve branch drill hole 11 may be larger than or equal to 20 m. In this way, the slurry diffusion ranges of two adjacent curve branch drill holes 11 would be intersected with each other. Therefore, an integrity and an impermeability of the second water-resisting cushion 12 would be ensured. Therefore, the leakage recharge from the water flowing fractured zone 4 can be completely blocked.

According to some examples of the present disclosure, the water flowing fractured zone 4 may be blocked through the curve branch drill holes 11. An average build angle rate of each curve branch drill hole 11 may be set as 13-17°/m. By blocking the water flowing fractured zone 4 with the curve branch drill holes 11 having a large average build angle rate, a thickness of the second water-resisting cushion 12 may be increased. Therefore, a blocking effect can be ensured, a grouting efficiency can be improved, and a grouting time can be saved.

According to some examples of the present disclosure, the second preset condition may be set according to general standards in the technical field of water-controlled coal mining of mines and grouting transformation of aquifers, in combination with actual situations of mining areas. For example, in a specific example, the second preset condition may be set as the grouting pressure caused by the second slurry is stabilized at about 4 MPa for more than 20 minutes. On condition that the second grouting process is performed until the second preset condition is met, it means that the second grouting process is completed.

Once the second preset ending condition is met, the second grouting process of the second slurry may be stopped. After the second slurry is solidified, the second water-resisting cushion 12 may be formed on or under a top of the water flowing fractured zone 4. The second water-resisting cushion 12 may block water flowing channels in the water flowing fractured zone 4 developed into a mined roof, and cut water inflows from the quaternary aquifer to the goaf 5 from the water flowing channels.

In Step S104, an amount of third slurry is grouted onto a top of the first water-resisting cushion 3 in an upward grouting manner until a third preset condition is met. This grouting process can be called as a third grouting process. Once the third preset condition is met, the third grouting process of the third slurry may be stopped. As a result, a third water-resisting cushion 14 on the top of the first water-resisting cushion 3 may be formed after the third slurry is solidified.

Figure 4:
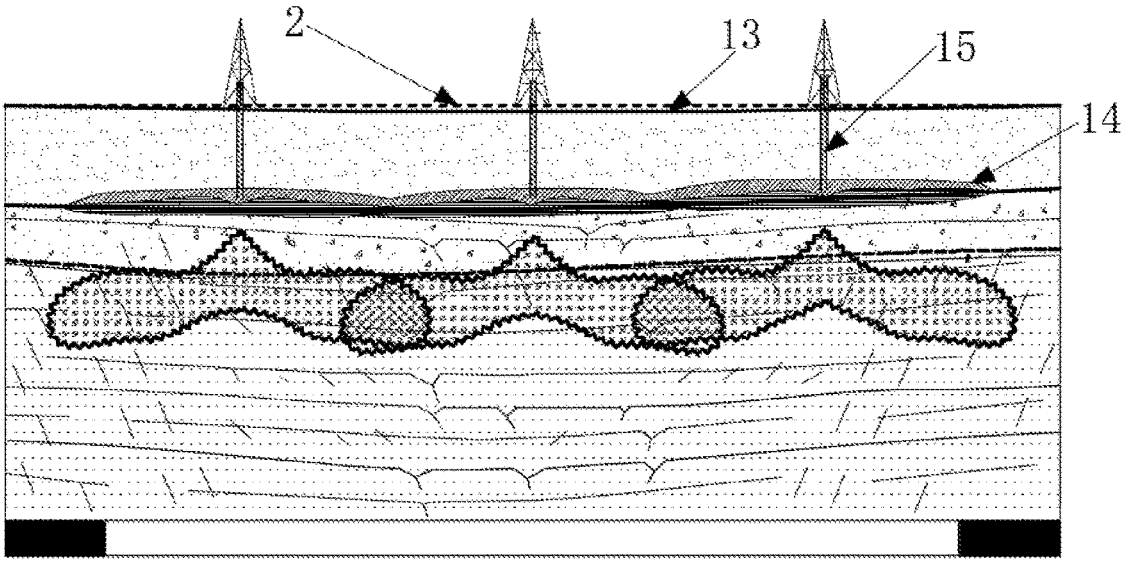
FIG. 4 is a flow chart illustrating a method for blocking mine water inrush according to some other examples of the present disclosure.

Specifically, referring to FIG. 4, after the water flowing fractured zone 4 is blocked, holes may be drilled upward to positions above the first water-resisting cushion 3. Then the third slurry with a larger viscosity may be grouted into the holes, so as to form the third water-resisting cushion 14. With the continuous grouting of the third slurry, a height of the third water-resisting cushion 14 may be continuously increased. In this way, a height of the surface horizon may be increased, thereby a degree of surface deformation caused by underground mining activities may be reduced. In another word, the surface deformation can be controlled.

According to examples of the present disclosure, the third preset condition may be set as follows: the amount of the third slurry grouted into the holes reaches a total grouting volume of the third slurry. In these examples, the total grouting volume of the third slurry may be determined according to the following formula (3).

$$Q=A\cdot S\cdot H\cdot \xi/K \quad (3)$$

Where, Q represents the total grouting volume of the third slurry; A represents a nonuniform diffusion loss coefficient; S represents an area ($m^2$) of the top of the first water-resisting cushion 3; H represents a subsidence amount (m) of the surface horizon; K represents a concretion rate of the third slurry; and ξ represents a compression deformation coefficient of the third water-resisting cushion 14.

To be noted, A, K and ξ are all constants, which relate to actual grouting situations and properties of the third slurry. For example, A may take a value of 1.1; K may take a value of 90%; and ξ may take a value of 1.2.

The subsidence amount of the surface horizon may be calculated according to mining intensities and related measured parameters. Then, the thickness of the third water-resisting cushion 14 may be estimated according to the subsidence amount of the surface horizon. At last, a total grouting volume of the third slurry may be calculated according to the subsidence amount of the surface horizon and the above formula (3) to ensure the thickness of the third water-resisting cushion 14 meets actual control requirements.

In the present disclosure, by continuously grouting the third slurry on the top of the first water-resisting cushion 3 to form the third water-resisting cushion 14, a total cushion height can be increased. Further, the height of the surface horizon can be increased accordingly, thereby surface deformations caused by mining can be controlled.

It can be seen from the above procedure that the whole grouting project include a downward grouting project in which the first water-resisting cushion 3 and the second water-resisting cushion 12 are formed, and an upward grouting project in which the third water-resisting cushion 14 is formed. In examples of the present disclosure, the downward grouting project is performed before the upward grouting project. To be noted, if the upward grouting project is operated before the downward grouting project, the second grouting process may become more complicated and tedious, which is an adverse to actual operations. That is because only after the second water-resisting cushion 12 is formed, the to-be-increased height of the surface horizon can be accurately measured. Moreover, only at this time, the third water-resisting cushion 14 can be grouted with a high efficiency and a high accuracy.

It can be seen from the method for blocking mine water inrush provided by the present disclosure, vertical leakage recharge from the quaternary aquifer to the weathered bedrock aquifer can be cut by the first water-resisting cushion 3 which is formed by grouting the first slurry into the interface between the quaternary aquifer and the weathered bedrock aquifer. Further, after mining, water flowing channels in the water flowing fractured zone 4 of a mined roof can be blocked by the second water-resisting cushion 12 which is formed by grouting the second slurry into the curve branch drill holes 11. In this way, water inflows from the quaternary aquifer to the goaf 5 may be cut by blocking the water flowing channels. Moreover, the total height of the cushions may be increased by continuing to grout the third slurry on the top of the first water-resisting cushion 3 to form the third water-resisting cushion 14. In this way, the height of the surface horizon may be increased accordingly and surface deformations caused by mining can be controlled. By grouting different slurry at different positions, a mine roof flooding can be prevented, and surface deformations can be controlled comprehensively and effectively, thereby groundwater resources can be protected and problems such as mine water inrush can be solved.

In some examples, a viscosity of the first slurry may be smaller than that of the third slurry. For example, the viscosity of the first slurry is smaller than 50 MPa·s, and a particle size of the first slurry is smaller than 60 μm. Further, the viscosity of the third slurry is between 50-70 MPa·s, and the particle size of the third slurry is smaller than 60 μm. In some examples, a fluidity of the first slurry is smaller than that of the second slurry. Moreover, a solidification rate of the first slurry is smaller than that of the second slurry.

Specifically, in the method disclosed, the first slurry is used to modify the weathered bedrock aquifer, the second slurry is used to block the water flowing fractured zone 4, and the third slurry is used to increase the height of the surface horizon.

As the first slurry has a poor fluidity and a small solidification rate (that is, the first slurry is slow in solidification), the first slurry may flow slowly in a slurry state, which may better drive water in fractures of the weathered bedrock aquifer, to ensure the grouting blocking effect.

As the second slurry has a good fluidity and a large solidification rate (that is, the second slurry is rapid in solidification), the second slurry may rapidly flow through the curve branch drill holes 11 and may be rapidly solidified, thereby weakening the dispersion effect of water flow scouring on the second slurry, and improving the blocking efficiency.

Due to a high viscosity of the third slurry, the stability of the third slurry in the diffusion process on the top of the first water-resisting cushion 3 can be ensured. That is, the third water-resisting cushion 14 can have a uniform thickness. Therefore, the surface horizon can be uniformly and effectively controlled. Moreover, inconsistency of the increased heights of various portions of the surface horizon can be avoided.

The first slurry includes the following components: water and cement with a mass ratio being 0.5:(1.0-1.2).

The second slurry includes the following components: cement, coal fly ash, bentonite, fine sands with a particle size being 1-5 mm and the water, where a mass ratio of the coal fly ash and the cement is 3.5-4.5; a mass ratio of the water and the cement is 0.7-1.2; a mass ratio of the bentonite to the water is 0.2-0.4; and a mass ratio of the cement and the fine sands is 0.5-0.8.

The third slurry includes the following components: water, cement and coal fly ash with a mass ratio being 0.5:(1.0-1.2):(0.5-1.0). Compared with the first slurry, coal fly ash is added to the third slurry, so as to increase the viscosity of the third slurry.

In the present disclosure, for different regions of the weathered bedrock aquifer, different grouting manners and different slurry can be used. Each slurry matches a specific grouting region, which ensures the grouting effect, and further saves a grouting cost.

Referring to FIG. 4, FIG. 4 illustrates a procedure of a method for blocking mine water inrush. Specifically, the method may include the following steps.

(1) Mine hydrogeological exploration: through an indoor mechanical test with relevant drilling data and other means, positions and depths of the quaternary aquifer and the weathered bedrock aquifer, physical and mechanical parameters of various rock stratus of the roof, and a depth of the interface 7 between the quaternary aquifer and the weathered bedrock aquifer are obtained. Further, a fracture pressure at the interface 7 is determined.

(2) Range of reconstruction region of water-resisting cushion: according to the methods and means of geophysical prospecting, drilling, transient electromagnetic measurement and detection on a flow velocity and a flow direction of groundwater, it can be determined whether there is a leakage recharge from the quaternary aquifer to a falling funnel region of the water flowing fractured zone. Meanwhile, it can be determined whether the water flowing fractured zone 4 has developed into the weathered bedrock aquifer. If the water flowing fractured zone 4 has developed into the weathered bedrock aquifer, the the water flowing fractured zone 4 would become a water flowing channel connecting the weathered bedrock aquifer and the quaternary aquifer. As a result, groundwater would flow into the goaf 5 along the water flowing fractured zone 4, and a large amount of water would flow into the goaf 5.

(3) Grouting parameters for water-resisting cushion reconstruction:

1) Fracture grouting is performed on the interface 7 between the quaternary aquifer and the weathered bedrock aquifer. By applying a grouting pressure exceeding the tensile strength at a weak consolidated surface of two rock stratus, the small principal stress surface with minimum resistance of the rock mass may produce hydraulic fractures, which would suddenly form a fracture surface in the rock mass. In this case, the volume of the slurry grouted would also increase.

In this method, the vertical stress at the interface between the two rock stratus can be determined according to a calculation formula: $\sigma_v=\gamma h$.

Where, $\gamma$ represents a volume weight ($N/m^3$) of a quaternary rock stratum; and h represent an average vertical distance (m) from the interface 7 between the quaternary aquifer and the weathered bedrock aquifer to the surface horizon.

As the grouting pressure is acting on the interface 7 between the rock stratus, a lateral stress of the interface 7 is mainly a relatively small friction force. That is, the lateral stress of the interface 7 is far smaller than the vertical stress of the interface 7. Therefore, the first slurry may mainly perform a horizontal fracture extension along the interface 7 between the quaternary aquifer and the weathered bedrock aquifer, thereby a horizontal grouting layer which is called a first water-resisting cushion 3 can be formed.

2) A slurry diffusion range of the fractured surface, i.e. a range of the first water-resisting cushion 3 of a single vertical drill hole 15 may be represent as the following formula:

$$R = 2.21\sqrt{\frac{0.093\gamma_g H b^2 r^{0.21} t}{\mu_g}} + r$$

Where, $\gamma_g$ represents a gravity density ($kN/m^3$) of the first slurry; H represents a difference between a grouting pressure head of the grouting pressure and a groundwater pressure head; b represents a fracture aperture; r represents a radius of the vertical drill hole 15 for grouting; t represents a grouting time; and $\mu_g$ represents a kinematic viscosity (MPa·s) of the first slurry.

According to some examples of the present disclosure, the grouting pressure head refers to a pressure at an opening of a grouting hole, and the underground water pressure head refers to a height of a water column promoting water to flow underground.

(4) Reconstruction process of water-resisting cushion:

a. Before mining, vertical drill holes are drilled into the interface 7 between the quaternary aquifer and the weathered bedrock aquifer, and the grouting pressure is increased to extrude the vicinity of the interface between the rock stratus, to make fractures along the interface 7.

b. After fracturing, the first slurry with the viscosity smaller than 50 MPa·s and the particle size being 60 μm is used for grouting. The grouting pressure is increased to make the first slurry to continuously extend along the interior of the horizontal interface. The first slurry includes the following components: water and cement with a mass ratio being 0.5:1.0.

c. If the grouting pressure is stabilized at about 2.5 MPa for more than 20 minutes, it means that the first grouting process is completed.

(5) Water flowing channel blocking

After first grouting process is completed, the second slurry is used for grouting instead. The second slurry includes the following components: cement, coal fly ash, bentonite, fine sands with a particle size being 1-5 mm and water. Where, a mass ratio of the coal fly ash and the cement is 4.0; a mass ratio of the water and the cement is 0.9; a mass ratio of the bentonite to the water is 0.23; and a mass ratio of the cement and the fine sands is 0.65. Taking the ratios as basic ratios, in an actual grouting process, the contents of the components of the second slurry can be dynamically adjusted based on the basic ratios. Finally, the second water-resisting cushion 12 may be formed.

There would be a large number of water flowing fractured zones 4 in a roof bedrock after mining. After the first water-resisting cushion 3 is completed, the hole is drilled downward, and a large quantity of second slurry capable of being rapidly condensed is used for grouting above the water flowing fractured zone 4. In this way, the second slurry would enter the water flowing fractured zone 4 to block water flowing channels. Therefore, underground water inflow can be reduced.

If the grouting pressure is stabilized at about 4 MPa for no less than 20 minutes, it means that the water flowing fractured zone 4 can be blocked.

(6) Control of surface deformation

After the water flowing fractured zone 4 is blocked, holes are drilled upward to the positions above the first water-resisting cushion 3, and the third slurry with a large viscosity is used for continuous grouting, so as to increase the height of the cushion. With the continuous increase in the height of the third water-resisting cushion 14, the height of the surface horizon is increased accordingly, thereby the degree of surface deformations caused by underground mining activities would be reduced. In this way, surface deformations can be controlled.

In some examples, the total grouting volume of the third slurry may be determined according to the following formula $Q=A\cdot S\cdot H\cdot \xi/K$. Where, Q represents the total grouting volume of the third slurry; A represents a nonuniform diffusion loss coefficient, taking a value of 1.1; S represents an area ($m^2$) of the top of the first water-resisting cushion 3; H represents a cushion height (m); K represents a concretion rate of the third slurry, taking a value of 90%; and $\xi$ represents a compression deformation coefficient of the third water-resisting cushion 14, taking a value of 1.2.

In some examples of the present disclosure, the third slurry may include the following components: water, cement and coal fly ash with a mass ratio being 0.5:1.0:1.0.

(7) Water-resisting cushion quality monitoring device and the use the device

In the grouting process of water-resisting cushion reconstruction, the grouting pressure, a grouting rate, grouting properties, grouting volume and different pressure durations may be carefully monitored and analyzed through a grouting monitoring system. Then the grouting pressure, a slurry ratio, the grouting volume and other parameters may be optimized and improved, thereby an optimal grouting effect for the water-resisting cushion may be achieved.

In the present disclosure, by using the fracture grouting method, characteristics of the interface between the rock stratus may be effectively used. The first slurry can be grouted in fractures along the interface to form the first water-resisting cushion 3. The first water-resisting cushion 3 formed at the interface has characteristics of large intensity, good impermeability and difficulty in deformation, which may effectively solve the problems of slurry percolation and the like in subsequent grouting process of the third water-resisting cushion 14.

Further, the diffusion radius of each vertical drill hole 15 is larger than or equal to 20 m; a diffusion range of the second slurry in the water flowing fractured zone 4 is larger than or equal to 20 m; and the interval between two adjacent vertical drill holes 15 is 30 m. In this way, the slurry diffusion ranges of two adjacent vertical drill holes 15 would be intersected with each other and the slurry diffusion ranges of two adjacent curve branch drill holes 11 would be intersected with each other two. Therefore, the integrity and the impermeability of the whole water-resisting cushions would be ensured.

The grouting of the water flowing fractured zone 4 after downward drilling is mainly to block water flowing channels of the water flowing fractured zone 4 formed in the roof of the mined coal seam 6. Therefore, groundwater would be prevented from flowing into the goaf 5.

The height of the third water-resisting cushion 14 is calculated according to the mining intensity and related parameters to obtain a subsidence amount. The grouting volume of the third slurry can be determined according to the subsidence amount, so that the height of the third water-resisting cushion 14 can reach the subsidence amount. Then, the grouting volume can be adjusted in real time by monitoring the surface subsidence amount. In this way, surface deformations caused by coal seam 6 mining can be controlled.

It can be seen that, the method disclosed can effectively make up for the deficiencies of conventional roof water flood prevention technologies. By integrating three grouting processes with different slurry at different positions, leakage recharge can be prevented, and surface deformations can be controlled comprehensively and effectively. Moreover, by the method disclosed, groundwater resources can be protected and problems such as mine water inrush can be solved.

Figure 5:
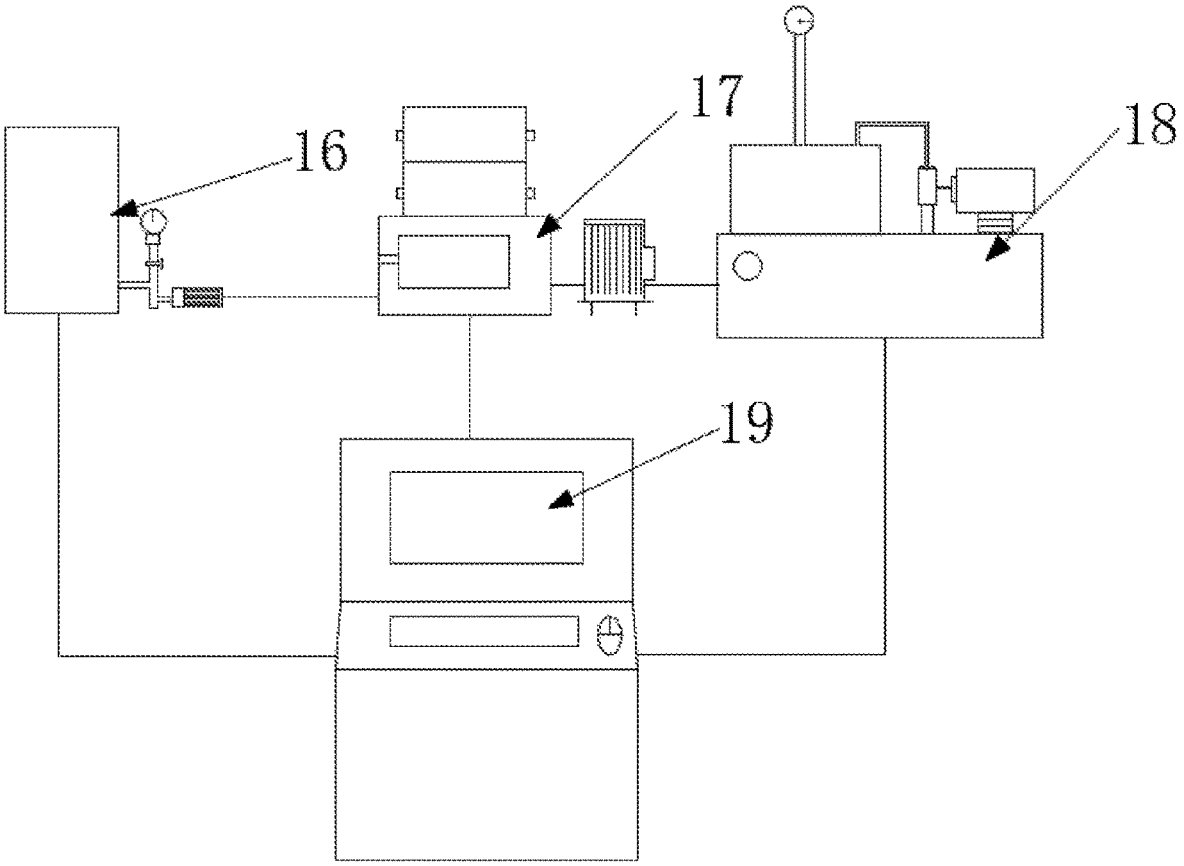
FIG. 5 is a schematic diagram illustrating a structure of a monitoring system for blocking mine water inrush according to examples of the present disclosure.

Based on the method disclosed, examples of the present disclosure further provide a system for blocking mine water inrush. Referring to FIG. 5, the system may include the following modules: a grouting volume monitoring module 16, a slurry property monitoring module 17, a grouting pressure monitoring module 18, and a comprehensive data processing module 19.

The grouting volume monitoring module 16 is electrically connected to the comprehensive data processing module 19. The grouting volume monitoring module 16 is configured to monitor grouting volumes of the first slurry, the second slurry and the third slurry in real time, and send a first monitoring result to the comprehensive data processing module 19.

The slurry property monitoring module 17 is electrically connected to the comprehensive data processing module 19. The slurry property monitoring module 17 is configured to monitor properties of the first slurry, the second slurry and the third slurry in real time, and send a second monitoring result to the comprehensive data processing module 19.

The grouting pressure monitoring module 18 is electrically connected to the comprehensive data processing module 19. The grouting pressure monitoring module 18 is configured to monitor grouting pressures of the first slurry, the second slurry and the third slurry in real time, and send a third monitoring result to the comprehensive data processing module 19.

In the grouting process of water-resisting cushion reconstruction, the grouting pressure, the grouting rate, the grouting properties, the grouting volume and different pressure durations are carefully monitored and analyzed through the system, so as to obtain evaluations on the grouting effect. Then, the grouting pressure, the slurry ratio, the grouting volume and other parameters can be optimized and improved, thereby ensuring an optimal grouting effect for the water-resisting cushion. Through the methods of forming water-resisting cushion constructions, water flowing fracture blocking, cushion thickness adjustment and the like, the roof flood prevention of the of coal seam 6 and surface deformation government can be finally achieved.

To be noted, the above system can be divided into various modules according to functions described. Certainly, when the present disclosure is implemented, the functions of various modules may be achieved in one or more software and/or hardware.

The system of the above examples is used for monitoring various parameters while implementing the corresponding method for blocking mine water inrush, and has the beneficial effects of the corresponding method, which will not be described in detail herein.

It should be noted that the method according to one or more examples of the present disclosure may be implemented by a single device, such as a computer or a server. The method may also be applied to a distributed scenario and may be completed by cooperations of a plurality of devices. In a case of the distributed scenario, one of the plurality of devices may merely implement one or more steps in the decoding method, and the plurality of devices may interact with each other to complete the decoding method.

It should be noted that, specific examples of the present disclosure have been described above. Other examples are within the scope of the appended claims. In some cases, the actions or steps recited in the claims can be performed in an order different from that in the examples, and can still achieve desired results. In addition, the processes depicted in the accompanying drawings are not necessarily required to be shown in a particular or sequential order, to achieve desired results. In some implementations, multi-task processing and parallel processing are also possible or may be advantageous.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A governance method for water inrush blocking of a coal seam roof and surface subsidence reduction, comprising the following steps:

conducting a geological prospecting in a mining region; wherein the geological prospecting comprises: prospecting positions, thickness and water distribution of a quaternary aquifer, a weathered bedrock aquifer and a water flowing fractured zone under a surface horizon; determining that the water flowing fractured zone has developed into the weathered bedrock aquifer and there is a leakage recharge from the quaternary aquifer to the weathered bedrock aquifer; wherein, the weathered bedrock aquifer is located under the quaternary aquifer;

grouting first slurry into an interface between the quaternary aquifer and the weathered bedrock aquifer in a fracture grouting manner until a first preset condition is met; stopping grouting the first slurry; and forming a first water-resisting cushion after the first slurry is solidified;

drilling a curve branch drill hole in the surface horizon downward from the surface horizon; wherein a top of the curve branch drill hole is located in the weathered bedrock aquifer and a bottom of the curve branch drill hole is located on or under a top of the water flowing fractured zone; grouting second slurry into the curve branch drill hole in a downward grouting manner until a second preset condition is met; stopping grouting the second slurry; and forming a second water-resisting cushion after the second slurry is solidified;

grouting third slurry onto a top of the first water-resisting cushion in an upward grouting manner until a third preset condition is met; stopping grouting the third slurry; and forming a third water-resisting cushion after the third slurry is solidified; wherein the third water-resisting cushion is located on the top of the first water-resisting cushion.

2. The governance method according to claim 1, wherein a grouting pressure of the first slurry is larger than or equal to a vertical stress at the interface between the quaternary aquifer and the weathered bedrock aquifer.

3. The governance method according to claim 1, wherein the method further comprises: before grouting the first slurry, drilling a vertical drill hole from the surface horizon downward; wherein, a bottom of the vertical drill hole is located at the interface between the quaternary aquifer and the weathered bedrock aquifer; the first slurry is grouted into the vertical drill hole; and the bottom of the vertical drill hole is connected to a top of the curve branch drill hole.

4. The governance method according to claim 3, wherein there are a plurality of vertical drill holes and a plurality of curve branch drill holes; each vertical drill hole is connected to at least two curve branch drill holes; and the at least two curve branch drill holes are symmetrically distributed taking a central axis of a corresponding vertical drill hole as an axis.

5. The governance method according to claim 4, wherein diffusion radii of the first slurry and the second slurry are both larger than or equal to 20 m; and an interval between two adjacent vertical drill holes is smaller than or equal to 30 m.

6. The governance method according to claim 1, wherein the third preset condition is as follows: a total grouting volume of the third slurry is determined according to a following formula:

$$Q=A\cdot S\cdot H\cdot \xi/K$$

wherein Q represents the total grouting volume of the third slurry; A represents a nonuniform diffusion loss coefficient; S represents an area ($m^2$) of a top of the first water-resisting cushion; H represents a subsidence amount (m) of the surface horizon; K represents a concretion rate of the third slurry; and represents a compression deformation coefficient of the third water-resisting cushion.

7. The governance method according to claim 1, wherein a viscosity of the first slurry is smaller than a viscosity of the third slurry.

8. The governance method according to claim 1, wherein a viscosity of the first slurry is smaller than 50 MPa·s and a particle size of the first slurry is smaller than 60 μm; and/or a viscosity of the third slurry is between 50 to 70 MPa·s and a particle size of the third slurry is smaller than 60 μm.

9. The governance method according to claim 1, wherein a fluidity of the first slurry is smaller than a fluidity of the second slurry; and a solidification rate of the first slurry is smaller than a solidification rate of the second slurry.

10. The governance method according to claim 1, wherein the first slurry comprises the following components: water and cement; and/or the second slurry comprises the following components: cement, coal fly ash, bentonite, fine sands with a particle size being 1 to 5 mm and water; and/or the third slurry comprises the following components: water, cement and coal fly ash.

* * * * *